US008899385B2

(12) United States Patent
Frailing et al.

(10) Patent No.: US 8,899,385 B2
(45) Date of Patent: Dec. 2, 2014

(54) SYSTEMS FOR RETARDING THE SPEED OF A RAILCAR

(75) Inventors: Andrew J. Frailing, Waterford, WI (US); James E. Thompson, Milwaukee, WI (US)

(73) Assignee: Precision Rail and Mfg., Inc., Oak Creek, WI (US)

( * ) Notice: Subject to any disclaimer, the term of this patent is extended or adjusted under 35 U.S.C. 154(b) by 634 days.

(21) Appl. No.: 13/117,217

(22) Filed: May 27, 2011

(65) Prior Publication Data

US 2011/0315491 A1 Dec. 29, 2011

Related U.S. Application Data

(60) Provisional application No. 61/353,840, filed on Jun. 11, 2010, provisional application No. 61/354,025, filed on Jun. 11, 2010.

(51) Int. Cl.
*B61K 7/02* (2006.01)
*B61K 7/08* (2006.01)

(52) U.S. Cl.
CPC ..... *B61K 7/08* (2013.01)
USPC ..... 188/62; 104/26.2

(58) Field of Classification Search
USPC ..... 188/62; 104/249, 240, 251, 252, 26.2, 104/256
See application file for complete search history.

(56) References Cited

U.S. PATENT DOCUMENTS 3,227,246 A 1/1966 Wilson
3,519,107 A 7/1970 Bellinger
3,557,910 A 1/1971 Wilson
3,621,942 A 11/1971 Danieli
3,809,188 A 5/1974 Frank et al.
3,926,124 A 12/1975 Frank
3,946,973 A 3/1976 Budway et al.
4,027,595 A 6/1977 Frank et al.
4,098,374 A 7/1978 Frank
4,113,621 A 9/1978 Frank et al.
4,125,177 A 11/1978 Durraffourt
4,198,909 A 4/1980 Plantureux
4,235,403 A 11/1980 Gillen et al.
4,393,960 A 7/1983 Mazur et al.
4,480,723 A 11/1984 Ingvast et al.
4,650,038 A 3/1987 Bick
4,766,815 A 8/1988 Chongben et al.

(Continued)

FOREIGN PATENT DOCUMENTS

EP 1 122 144 A1 8/2001

*Primary Examiner* — Bradley King

(74) *Attorney, Agent, or Firm* — Andrus Intellectual Property Law, LLP

(57) ABSTRACT

Systems for retarding the speed of a railcar comprise: a brake; a hydraulic actuator moving the brake between a closed position in which the brake applies braking pressure on a wheel of the railcar and an open position in which the brake does not apply braking pressure on the wheel of the rail car; a hydraulic circuit comprising a first manifold and a second manifold; a pump configured to pump hydraulic fluid into at least one of the first manifold and the second manifold; and a logic element controlling pressure of the fluid in the first manifold such that when the wheel enters the brake and forces the brake towards the open position. The logic element reacts to maintain a selected pressure in the first manifold, thus causing a selected braking pressure to be applied by the brake on the wheel of the railcar.

30 Claims, 9 Drawing Sheets

(56) References Cited

U.S. PATENT DOCUMENTS

| | | | | |
|---|---|---|---|---|
| 4,867,279 | A | 9/1989 | Link et al. | |
| 4,967,511 | A | 11/1990 | Werginz et al. | |
| 4,996,793 | A | 3/1991 | Mazur | |
| 5,092,248 | A | 3/1992 | Parry | |
| 5,388,525 | A | 2/1995 | Bodkin | |
| 5,493,086 | A | 2/1996 | Murphy et al. | |
| 5,494,342 | A | 2/1996 | Engle | |
| 5,676,337 | A | 10/1997 | Giras et al. | |
| 5,730,260 | A | 3/1998 | Thyssen | |
| RE36,036 | E | 1/1999 | Engle | |
| 5,904,321 | A | 5/1999 | Cox et al. | |
| 6,152,042 | A | 11/2000 | Barry et al. | |
| 6,199,671 | B1 | 3/2001 | Thyssen | |
| 6,216,525 | B1 | 4/2001 | Bernd et al. | |
| 6,422,519 | B1 | 7/2002 | Braatz | |
| 7,140,698 | B2 | 11/2006 | Braatz et al. | |
| 7,306,077 | B2 | 12/2007 | Heyden et al. | |
| 7,325,567 | B2 | 2/2008 | Heyden et al. | |
| 7,392,887 | B2 | 7/2008 | Heyden et al. | |
| 8,413,770 | B1 * | 4/2013 | Heyden et al. | 188/62 |
| 2008/0237511 | A1 | 10/2008 | Heyden et al. | |

* cited by examiner

SYSTEMS FOR RETARDING THE SPEED OF A RAILCAR

CROSS-REFERENCE TO RELATED APPLICATION

The present application claims priority to and the benefit of U.S. Provisional Patent Application Ser. Nos. 61/353,840 and 61/354,025, filed Jun. 11, 2010, the disclosures of which are hereby incorporated herein in entirety.

FIELD

The present disclosure generally relates to retarders of the kind suitable for reducing the speed of a railcar riding along a set of rails.

BACKGROUND

U.S. Pat. No. 4,393,960; the disclosure of which is hereby incorporated herein by reference in entirety; discloses a brake shoe structure that includes a series of alternating long brake shoes and short brake shoes mountable on adjacent brake beams in a railroad car retarder. The length of the long brake shoe is such that the long brake shoe symmetrically straddles two adjacent brake beams. The length of the short brake shoe is such that the shoe occupies the spacing on the brake beams between two long brake shoes. The long brake shoes are affixable to each of the brake beams in at least two locations. The brake shoes contain a plurality of slanting slots in their braking surfaces for interrupting harmonics producing screeching noises during retardation. The brake shoes may be formed of steel or heat treatable ductile iron.

U.S. Pat. No. 7,140,698; the disclosure of which is hereby incorporated herein by reference in entirety; discloses a hydraulic control and operating system for a railroad car retarder to control the movement of railroad cars in railroad classification yard. The system utilizes a double-acting hydraulic cylinder to operate the retarder mechanism and includes a hydraulic control circuit that provides protection against pressure spikes and high pressure excursions, high and low temperature excursions, low oil levels and oil filter fouling. The system shuts itself down to prevent damage, and provides a warning to maintenance staff that service should be performed long before a need for system shut-down is required. The system includes a central operating panel in the rail yard control center, remote control panel located at the position of the retarder and the system can be connected for operation from a completely remote location.

U.S. patent application Ser. No. 12/349,753; the disclosure of which is hereby incorporated herein by reference in entirety; discloses systems for and methods of operating electro-hydraulic retarders. In one example, a system is provided for retarding the speed of a railcar. The system includes a brake, a hydraulic actuator coupled to the brake, and a hydraulic circuit that directs pressurized hydraulic fluid to the actuator. The fluid causes the actuator to move the brake towards a closed position in which the brake will apply a predetermined braking pressure on a wheel of the railcar. A hydraulic accumulator is coupled to the hydraulic circuit and configured to accumulate fluid from the hydraulic circuit when the wheel forces the brake out of the closed position and to supply pressurized accumulated fluid back to the hydraulic circuit when the brake moves back into the closed position to thereby maintain a substantially constant braking pressure on the wheel of the railcar as it moves through the brake.

U.S. patent application Ser. No. 12/349,801; the disclosure of which is hereby incorporated herein by reference in entirety; discloses electro-hydraulic retarders designed to allow opposing brake shoes on the retarder to spread to the width of a wheel entering the retarder, and yet still maintain a desired braking pressure on the sides of the wheel. In one example, the retarder includes a brake and a brake actuator that has a piston-cylinder and a spring. One or both of the piston and the cylinder acts on the brake and the other of the piston and the cylinder acts on one end of the spring. The other end of the spring acts on the brake. In one example, the spring is wrapped around the cylinder and connected thereto in series. In such an arrangement, supplying pressurized hydraulic fluid to the piston-cylinder causes both the piston-cylinder and the spring to move the brake towards a closed position in which the brake will apply a predetermined braking pressure on a wheel of the railcar. The spring resiliently biases the brake into the closed position to maintain a substantially constant braking pressure on the wheel of the railcar as it moves through the retarder.

SUMMARY

The present disclosure arises from the present inventor's research and development of electro-hydraulic systems for retarding the speed of a railcar traveling on a set of rails. The inventors have recognized that more efficient and effective electro-hydraulic retarder systems and methods of operating such systems are needed in the art. For example, in current electro-hydraulic retarder systems, when a wheel enters the system, the system is ideally capable of allowing the brake shoes to spread apart to the width of the wheel and yet still maintain a desired pressure on the side of the wheel. The system ideally also allows for quick application and removal of pressure on the sides of the wheel. However the present inventors have realized that because hydraulic fluids are generally incompressible, it is difficult to use hydraulics to power the system in such a way that the brake shoes will quickly spread apart to accept an entering wheel and conform to various widths of railcar wheels while maintaining consistent pressure on the sides of the wheel. Further, the inventors have realized that many current electro-hydraulic retarders have metal-on-metal wear surfaces and linkages that require maintenance and often do not meet desired life expectations.

Through research and development the inventors have invented the systems and methods disclosed herein, which overcome many of these deficiencies in the prior art.

In one example, a system for retarding the speed of a railcar comprises a brake; a hydraulic actuator moving the brake between a closed position in which the brake applies braking pressure on a wheel of the railcar and an open position in which the brake does not apply braking pressure on the wheel of the rail car; a hydraulic circuit comprising a first manifold and a second manifold; a pump configured to pump hydraulic fluid into at least one of the first manifold and the second manifold; and a first logic element controlling pressure of the fluid in the first manifold such that when the wheel enters the brake and forces the brake towards the open position, the logic element reacts to maintain a selected pressure in the first manifold, thus causing a selected braking pressure to be applied by the brake on the wheel of the railcar.

In another example, a control circuit selects the braking pressure from a plurality of different braking pressures and controls the first logic element to apply the braking pressure on the wheel of the railcar.

In yet another example, the first logic element comprises a pressure control valve and a pilot control valve controlling the pressure control valve. The control circuit controls the pilot control valve to thereby control the pressure control valve and thus the pressure of the fluid in the first manifold. The control circuit is configured to send a plurality of different signals to the pilot control valve, each signal in the plurality causing the pilot control valve to control the pressure control valve to achieve a different one of a plurality of different pressures of fluid in the first manifold, which each correspond to a different one of the plurality of different braking pressures. The pilot control valve controls the pressure control valve by controlling pressure of fluid in a pilot line coupled to the pressure control valve. The pressure of the fluid in the pilot line is maintained proportional to the plurality of different signals. The pressure of fluid in the first manifold, which is controlled by the pressure control valve, is maintained proportional to the pressure of the fluid in the pilot line.

In yet another example, the actuator comprises a piston disposed in a cylinder. The piston extends from the cylinder into an extended position to move the brake into the closed position and retracts into the cylinder into a retracted position to move the brake into the open position. The piston defines a passageway there-through. The passageway facilitates flow of fluid from a cap-side of the cylinder to a rod-side of the cylinder when the piston is moved from the extended position to the retracted position, thus facilitating movement of the brake from the closed position to the open position.

Further examples are provided herein and will be described herein after with reference to the following drawing FIGURES.

DETAILED DESCRIPTION OF THE DRAWINGS

In the present disclosure, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

Figure 1:
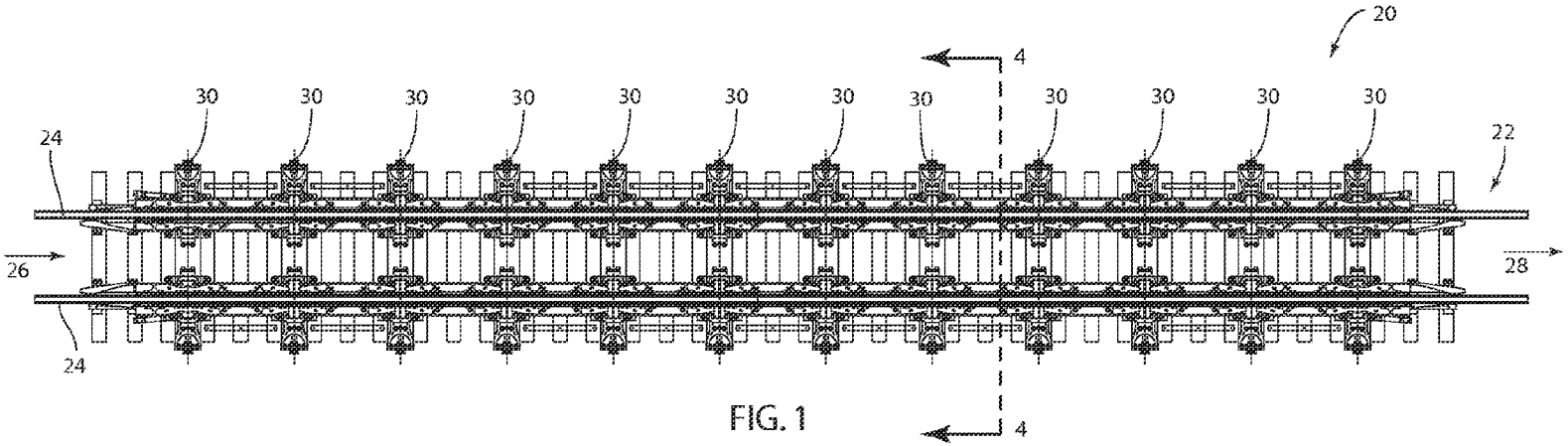
FIG. 1 is a plan view of a pair of rails and a retarder system for reducing the speed of a railcar riding on the rails.
Figure 2:
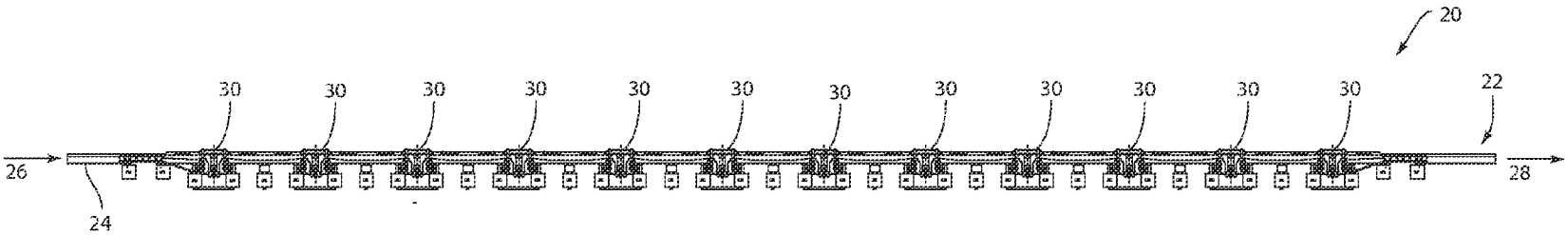
FIG. 2 is a side view of the pair of rails and retarder system depicted in FIG. 1.

FIGS. 1 and 2 depict a railcar retarder system 20 that is mounted along a section of track 22, including a pair of conventional rails 24. The section of track 22 continues in both directions from the system 20 with railcars entering the system 20 from the left in the direction shown by arrow 26 and exiting to the right in the direction shown by arrow 28. The retarder system 20 includes a series of pairs of brakes 30 positioned on opposite sides of each of the rails 24. The brakes 30 are positioned alongside and on top of the rails 24 such that, when actuated, the brakes 30 engage the sides of the railcar wheels to brake or retard the moving railcar. Although the particular example shown depicts a two series 29*a*, 29*b* (see FIG. 3) of six pairs of brakes 30, it should be recognized that the number and arrangement of the brakes 30 can vary from that shown depending upon various operational parameters. In the example shown, each series 29*a*, 29*b* includes six pairs of brakes 30 that are connected in series to a power unit comprising a hydraulic circuit 32. In use, each hydraulic circuit 32 receives and directs pressurized hydraulic fluid to the brakes 30 to actuate the brakes 30, as is further discussed herein below.

Figure 3:
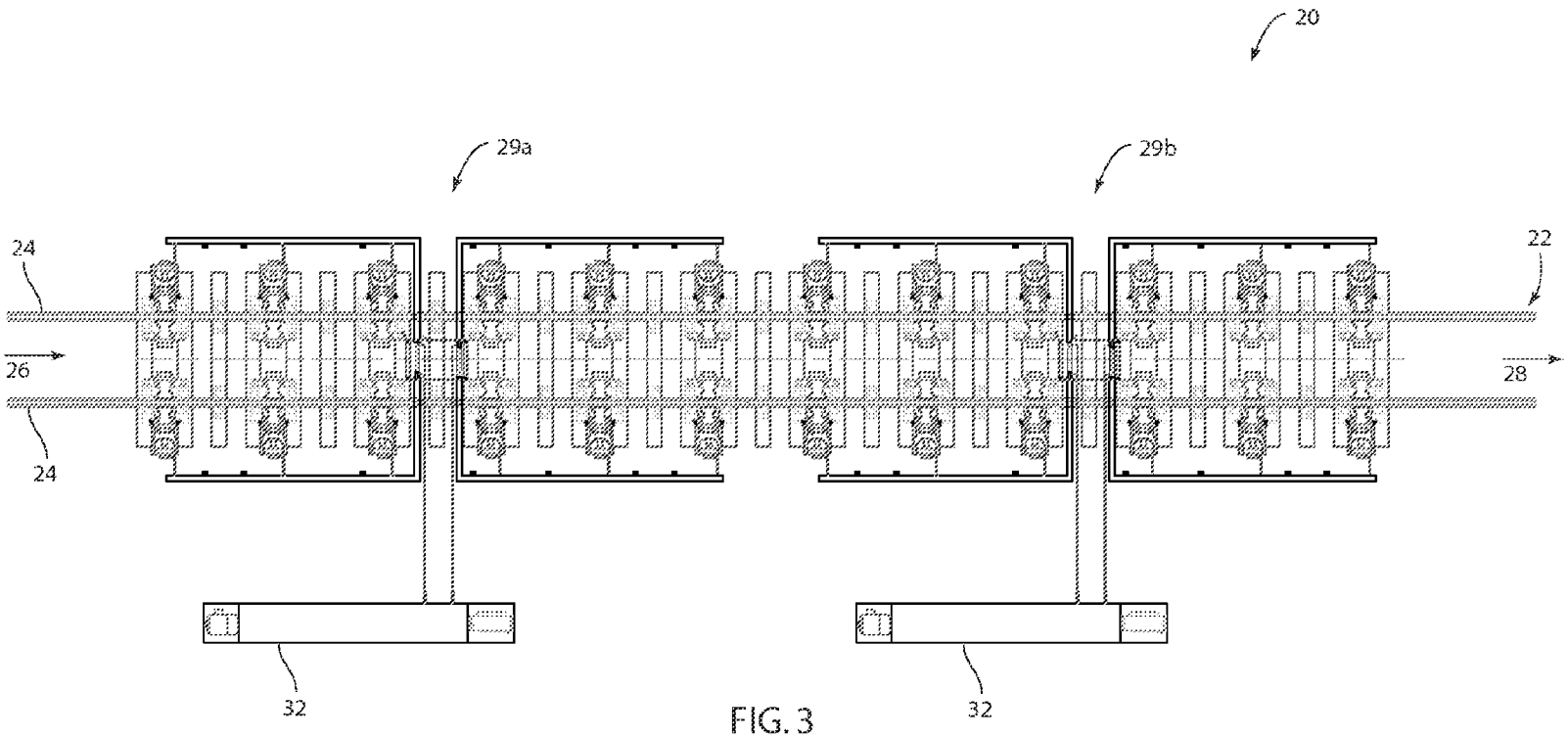
FIG. 3 is a plan view of the pair of rails shown in FIG. 1, further depicting hydraulic systems for operating the retarders.

FIG. 3 is a view showing the retarder system 20 and more particularly showing the hydraulic circuit 32. Portions of the brakes 30 are omitted to more clearly show the hydraulic circuit 32.

Figure 4:
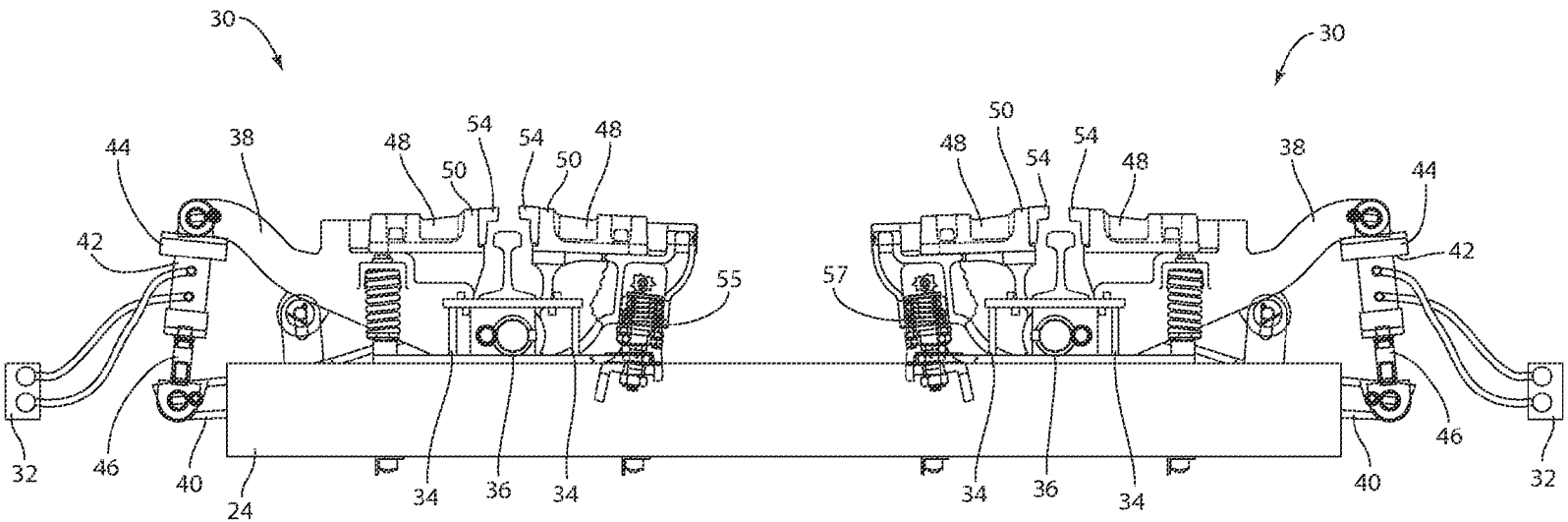
FIG. 4 is a section view taken through section 4-4 in FIG. 1, showing a brake.

FIG. 4 depicts Section 4-4 of FIG. 1. FIG. 4 is representative of each pair of brakes 30 in the retarder system 20. Generally, each brake 30 includes rail supports 34 to which a rail 24 is secured. Each rail support 32 contains a fulcrum pin 36 supporting upper and lower levers 38, 40, which together function as a brake 30. The fulcrum pin 36 passes through an end of upper lever 38 and also through a center portion of lower lever 40. A brake beam 48 is secured to each of the levers 38, 40. The position of the brake beam 48 on the levers 38, 40 can be adjusted by an adjustment mechanism extending through flanges on the lever arms, according to known arrangements such as those described in U.S. Pat. No. 4,393,960. Brake shoes 50 are mounted on the brake beams 48. The brake shoes 50 are generally L-shaped, having a short arm containing braking surface 54 supported by a flange mounted to the brake beam 48. The hydraulic circuit 32 is connected to a hydraulic actuator, which is movable under hydraulic forces to move the retarder between the open and closed positions. Different types of hydraulic actuators could be used, such as for example a plunger cylinder and/or the like. In the particular example shown, the actuator includes a hydraulic piston-cylinder 42 having a cylinder 44 connected to the end of one of the levers 38, 40 and a piston-rod 46 connected to the other.

Figure 6:
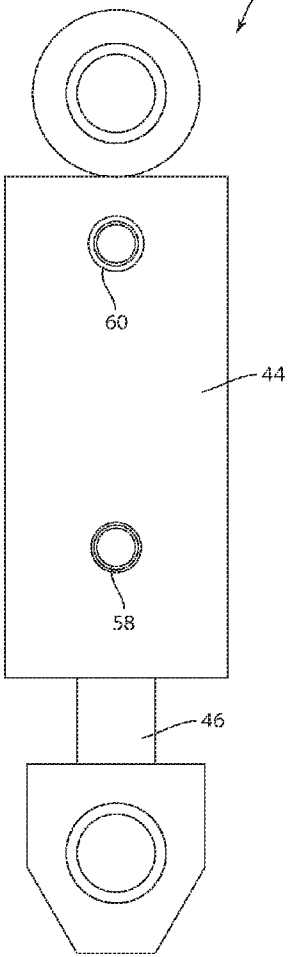
FIG. 6 is a side view of the actuator.
Figure 5:
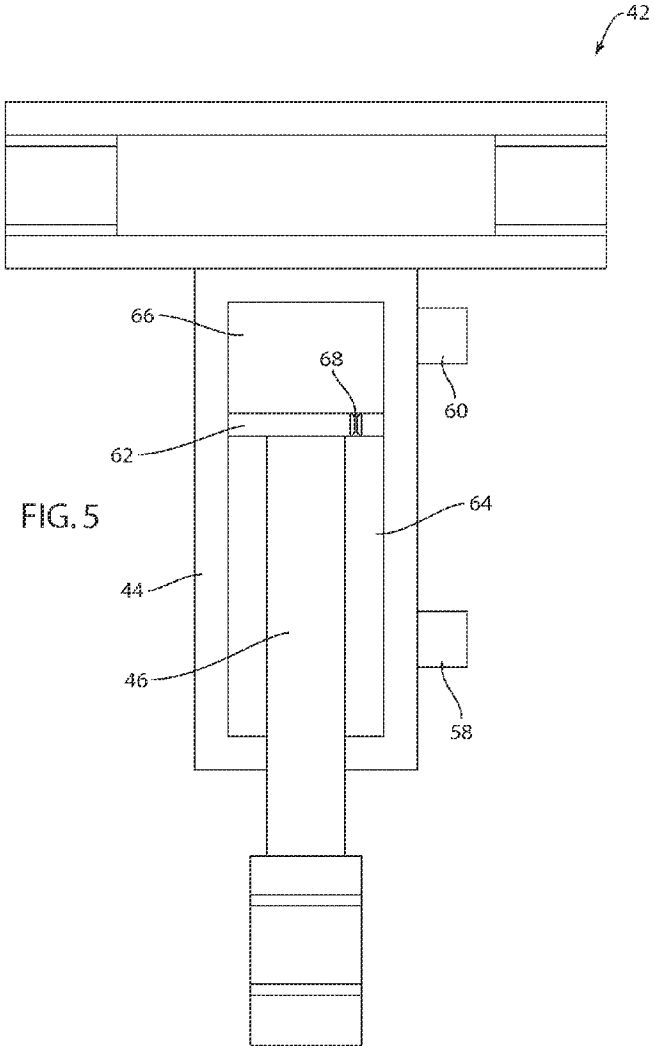
FIG. 5 is a section view of an actuator, including a piston, piston-rod, and cylinder.

FIGS. 5 and 6 show a sectional view and side view, respectively, of an exemplary piston-cylinder 42. The piston-cylinder 42 includes a pair of hydraulic ports including a rod-side port 58 and a cap-side port 60. A piston 62 is disposed on the internal end of the piston-rod 46 and divides the cylinder 44 into two chambers 64, 66, including a rod-side chamber 64 and a cap-side chamber 66. The piston 62 is connected to piston-rod 46, which extends from the piston-cylinder 42. Rod-side hydraulic port 58 is in fluid communication with rod-side chamber 64 and cap-side hydraulic port 60 is in fluid communication with cap-side chamber 66. A passageway in the form of an orifice 68 is defined in the piston 62 and facilitates flow of hydraulic fluid between the rod-side chamber 64 and the cap-side chamber 66. Optionally, the passageway can have a one-way valve (not shown) that only allows passage of hydraulic fluid from one of the rod-side chamber 64 and cap-side chamber 66 to the other of the rod-side chamber 64 and cap-side chamber 66, such as for example only from the rod-side chamber 64 to the cap-side chamber 66. In another example, the passageway 68 can comprise a flow path (not shown) defined by for example tubing around the outside of the cylinder, fluidly connecting the rod-side chamber 64 and cap side chamber 66. As will be explained further herein below, the passageway facilitates quicker movement of the piston-cylinder 42 between its open and closed positions. In some examples, the passageway can also provide heating of the hydraulic fluid. As hydraulic fluid is pumped by the retarder system 20, as will be described further herein below, restricted passage of fluid through the passageway heats both the fluid and the piston-cylinder 42, which can be particularly advantageous for example in cold weather environments.

In use, the hydraulic circuit 32 conveys hydraulic fluid to and from the piston-cylinder and controls the pressure of the hydraulic fluid to move the brake 30 between its closed position and its open position and to apply selected braking pressures to the wheel of the railcar. Specifically, the hydraulic piston-cylinder 42 is movable under hydraulic pressure from the circuit 32 between an extended position, wherein the piston-rod 46 extends from the cylinder 44 to move the brake 30 into the closed position and a retracted position wherein the piston-rod 46 retracts into the cylinder 44 to move the brake 30 into the open position. When it is desired to retard the motion of a railcar riding on rails 24, more hydraulic fluid is provided to one end of the piston-cylinder 42 via the hydraulic circuit 32 to actuate the piston-cylinder 42 to extend piston-rod 46. The piston-cylinder 42 pivots the ends of levers 38, 40 apart, and thus moves the brake shoes 50 towards each other and into contact with a railcar wheel. Brake shoes 50 contact the inside and outside of a railcar wheel riding on the rail to apply a braking pressure. To decrease or terminate the retarding action, the fluid pressure on the end of the piston-cylinder is decreased and the return springs 55, 57 and the weight of the upper lever 38 move the ends of levers 38, 40 together and thus move the brake shoes 50 outwardly away from the railcar.

Figure 7:
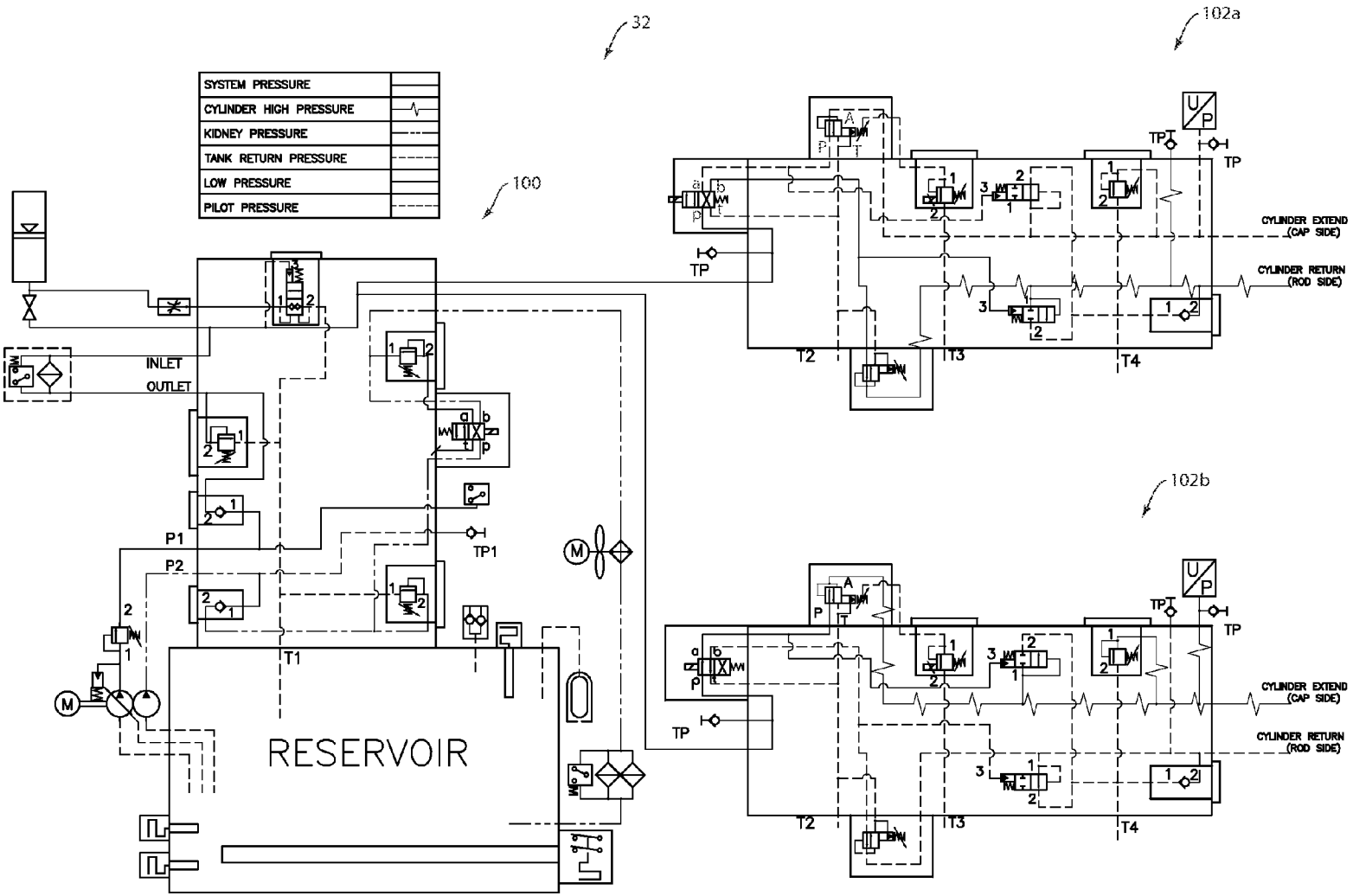
FIG. 7 is a schematic view of an electro-hydraulic system for operating the retarder, including a main manifold and secondary manifolds.

A non-limiting example of the hydraulic circuit 32 and related components will now be described with reference to drawing FIGS. 7 through 11. FIG. 7 depicts the hydraulic circuit 32, including a main manifold 100 and two secondary manifolds 102. For illustrative purposes, the secondary manifolds 102 are shown in FIG. 7 in different conditions, namely during a condition wherein the brake 30 is opened, see 102*a*, and a condition wherein the brake is closed, see 102*b*. The main manifold 100 is shown in detail in FIG. 8. The closed and opened conditions are shown in further detail in FIGS. 9 and 11, respectively, and will be detailed further herein below. The manifolds 102 are each connected to both sides of the piston-cylinders 42, so as to actuate the piston-cylinder 42, as described above and further herein below. The condition wherein a wheel enters the system 20 and pushes on the brake shoes 50 is shown in FIG. 10.

Figure 8:
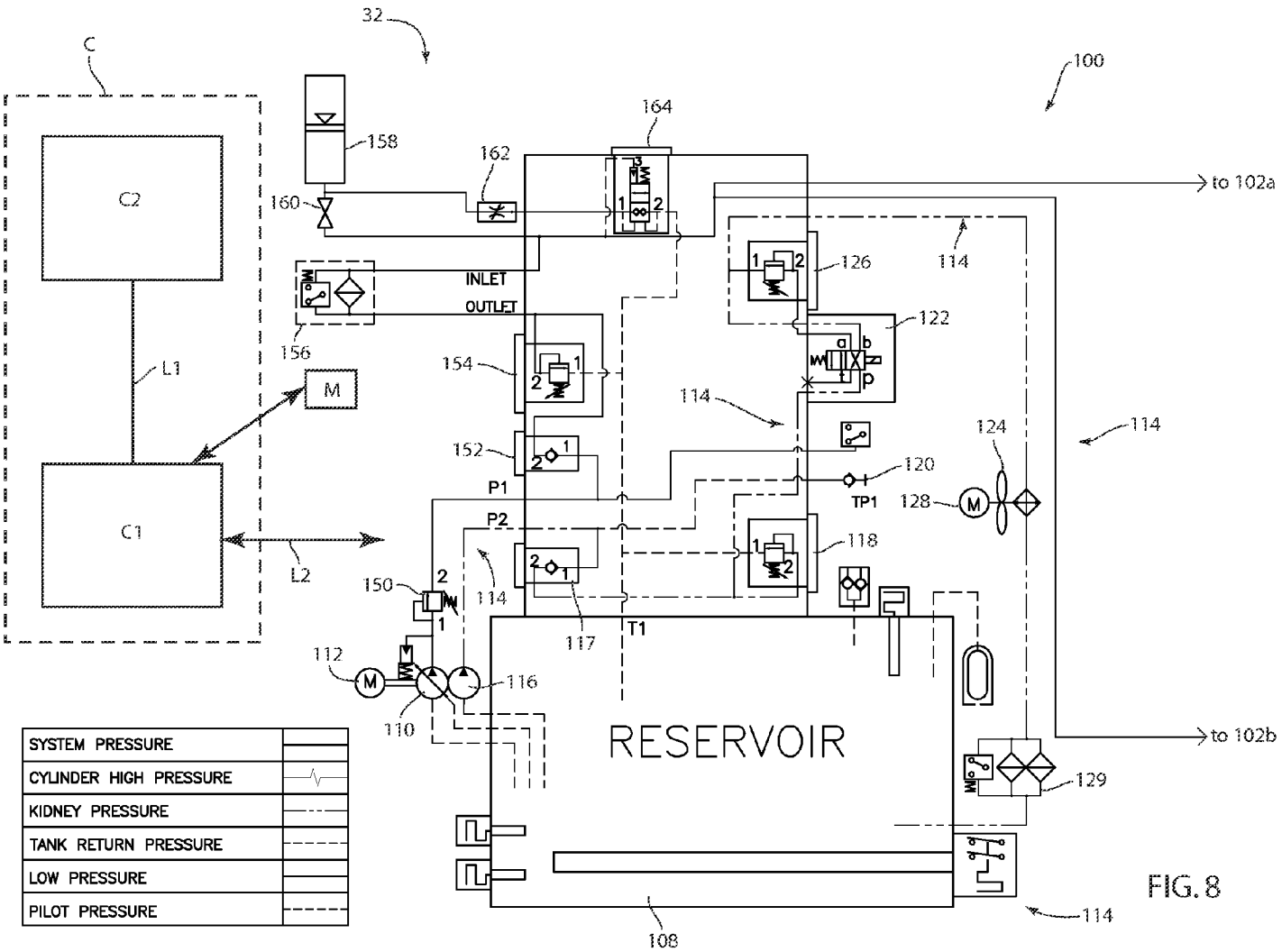
FIG. 8 is a schematic view of an exemplary main manifold.

As shown in FIG. 8, the retarder system 20 also includes a control circuit C, which can be located remotely from the retarder system 20, such as at the yard tower (not shown) and/or adjacent to the rest of the retarder system 20, such as shown in FIG. 7. In the example shown, the control circuit C includes a first control section C1 located remotely from the retarder system 20 and a second control section C2 located with the retarder system 20. The sections C1 and C2 are programmable and configured to send and receive electronic commands via a wired or wireless link L1. The control circuit C is also configured to send and receive signals with a location monitor M, which can include a conventional wheel detector, presence detector, radar, laser, pressure transducer, and/or the like, to determine if a railcar is approaching and/or in the retarder system 20. As a railcar approaches the retarder system 20, the control circuit C monitors environmental factors and/or characteristics of the railcar such as weight, velocity, direction and the like, and thereafter calculates an amount of braking pressure necessary to achieve a desired railcar speed. Based upon this calculation, the control circuit C is programmed to control operations of the various components of the retarder system 20 via one or more wired or wireless links as shown schematically at L2, as further described herein below, to achieve a selected braking pressure. Braking pressure is typically defined in the art in terms of weight classes. An example of typical weight classes are as follows:

| | |
|---|---|
| LIGHT | 262-394 pounds per square inch (psi) |
| MEDIUM | 657-788 psi |
| HEAVY | 1051-1182 psi |
| EXTRA HEAVY | 1445-1576 psi |

As described further herein below, the control circuit C is configured to control one or more components of the retarder system 20 to apply and maintain a predetermined braking pressure on the wheel(s) of the railcar and to control the speed of the railcar as it travels through and leaves the system 20. Prior to the wheel entering the system 20, the control circuit C can control the retarder system 20 to open and/or close the brakes 30 with minimal pressure. Once the railcar is in the system, the control circuit C can quickly change braking pressures applied to the wheel(s) in accordance with predetermined or active parameters set by the control circuit C and/or entered by an operator into the system 20 via a conventional computer input device (not shown). Each of these functions is accomplished by the programming of the control circuit C and its electronic communication with the various components of the system 20 via wired or wireless links, which are not all specifically depicted in the drawings, but the nature of which will be understood by one having ordinary skill in the art.

Referring to FIG. 8, the main manifold 100 of the hydraulic circuit 32 includes a kidney loop 114 configured to control temperature of the fluid in the circuit 32. In the example shown, the control circuit C controls a constant volume pump 116, which pumps hydraulic fluid from the reservoir 108 into the kidney loop 114. The pump 116 is driven by a conventional motor 112. Hydraulic fluid flows from the pump 116 through a check valve 117 that prevents back spinning of the motor 112. Hydraulic fluid then passes through a variable pressure relief valve 118 that ensures that the kidney loop 20 is not over-pressurized. A test point 120 is provided so that pressure which the variable pressure relief valve 118 acts can be adjusted. The hydraulic fluid is directed to a directional control valve 122, which under the control of the control circuit C has the capability of either directing the flow to a heat exchanger 124 or to force flow over a variable pressure relief valve 126 restricting flow of fluid through the kidney loop 114 to heat the fluid. The pressure relief valve 126 can be pre-set to function at a certain pressure, such as for example 200 psi. This valve 126 is thus used to generate heat. If the control circuit C determines that the fluid in the hydraulic circuit 32 is relatively cold (under a predetermined temperature, such as for example 70° F.), it controls the directional control valve 122 to direct the hydraulic fluid over the pressure relief valve 126. If the hydraulic fluid is relatively warm, the control circuit C controls the directional control valve 122 to direct the fluid around the pressure relief valve 126. Further, if the hydraulic fluid is determined by the control circuit C to be overly warm or hot (e.g. over 100° F.), the control circuit operates a fan 128 on the heat exchanger 124 to cool the fluid. After being heated/cooled, the hydraulic fluid passes through two filters 129. Optionally, each filter 129 can have a pressure switch to indicate when the filters are creating too much back pressure and need replacement. In the event that the filters are not replaced on time, there can be a bypass that allows hydraulic fluid to flow around the filters 129. There can also be a visual indicator on the top of the filters 129 to provide a user with the status of the pressure drop across the filters 129.

With continued reference to FIG. 8, the retarder system 20 also includes a variable displacement pump 110 connected to and providing hydraulic fluid to the hydraulic circuit 32 to actuate the piston-cylinder 42. The pump 110 is powered by a conventional motor 112 and can be controlled by the control circuit C. In use, the pump 110 pumps hydraulic fluid, such as oil from the reservoir 108 into the hydraulic circuit 32 and specifically into the main manifold 100. Hydraulic fluid from the pump 110 passes over a pressure relief valve 150, which dampens out pressure oscillations and ensures that the pump 110 has a minimal amount of pilot pressure. The hydraulic fluid then passes through a check valve 152 to ensure that the pump 110 is not back spun when the motor 112 is shut off. The hydraulic fluid then flows past a pressure relief valve 154 which protects the retarder system 20 from over pressurizing. For example, the pressure relief valve 154 can be set at 2000 psi (e.g., 400 psi higher than typical standard operating pressure). If the pressure in the circuit 32 increases to above 2000 psi, the pressure relief valve 154 opens and discharges fluid back to the reservoir 108. After flowing through the pressure relief valve 154, the hydraulic fluid flows through a high pressure filter 156, which protects an accumulator 158 and other system components from contamination. Hydraulic fluid can then flow to either the accumulator 158 or directly to the secondary manifold 102, whichever has the lowest pressure.

The accumulator 158 can include any one of a variety of hydraulic energy storage devices, such as a compressed gas or gas-charged accumulator and/or the like. In the example shown, the accumulator 158 includes a cylinder having two chambers that are separated for example by an elastic diaphragm, a totally enclosed bladder, or a floating piston. One chamber contains an inert gas under pressure or "precharge" that provides compressive force on the hydraulic fluid in the circuit. In this example, the accumulator 158 and pump 110 supply hydraulic fluid in parallel to the secondary manifold 102 and ultimately to the piston-cylinder 42. The hydraulic fluid flows from the pump 110 to the one of the accumulator 158 and the portion of the circuit 32 downstream of the accumulator 158 that has the lower pressure. If the hydraulic fluid flows towards the accumulator 158, it first passes through a shut off valve 160, which allows for servicing of the accumulator 158. A needle valve 162 and a dump valve 164 ensure that hydraulic fluid in the accumulator 158 is directed back to the reservoir 108 at a regulated rate when the retarder system 20 is shut down.

In the example shown, two secondary manifolds 102 are provided for each section of retarder system 20. Each pair of manifolds 102 operates in unison to affect opening and closing of the brakes 30. The following describes the function and purpose of just one of the secondary manifolds 102; however it should be recognized that this description equally applies to each secondary manifold 102 in the retarder system 20.

Figure 9:
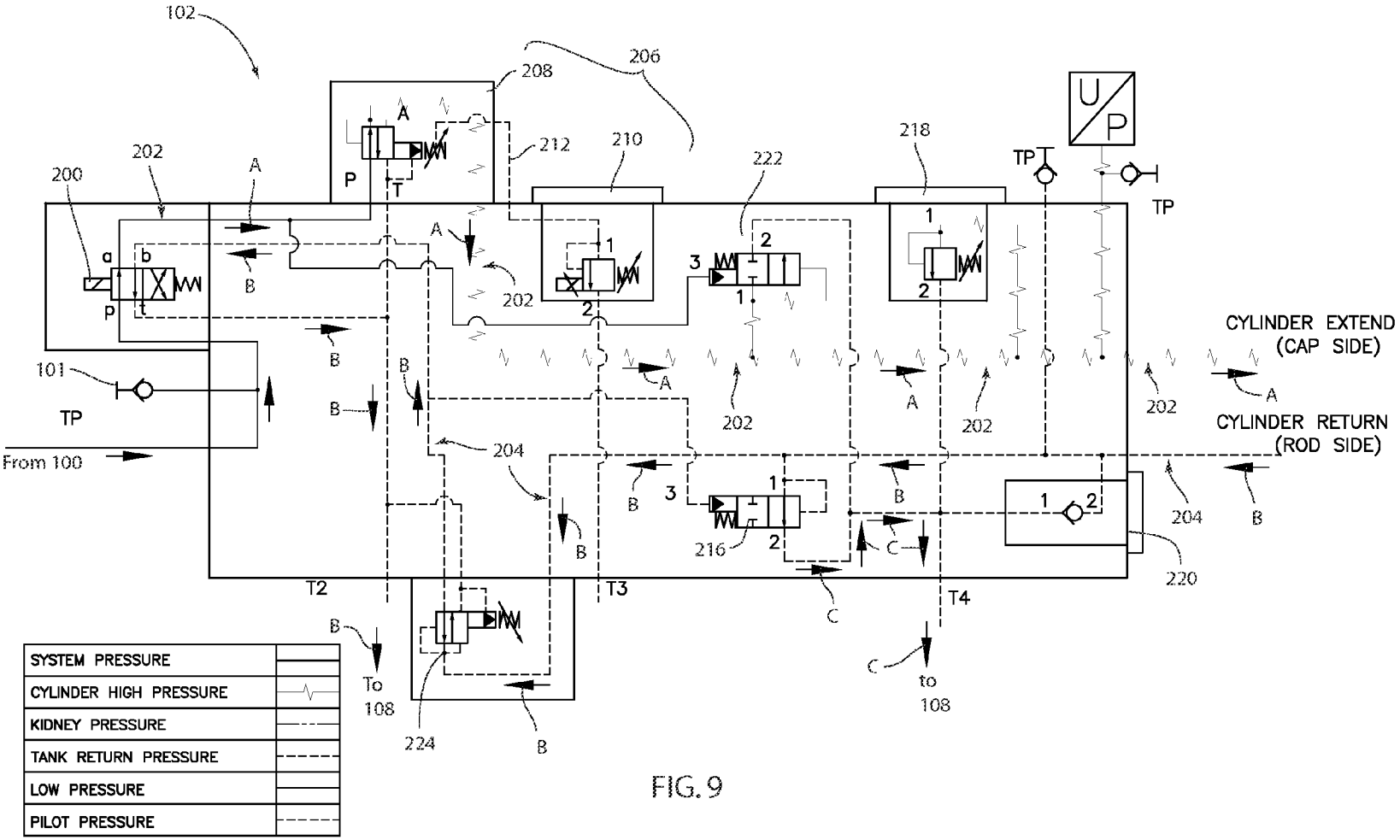
FIG. 9 is a schematic view of an exemplary secondary manifold closing the retarder.
Figure 10:
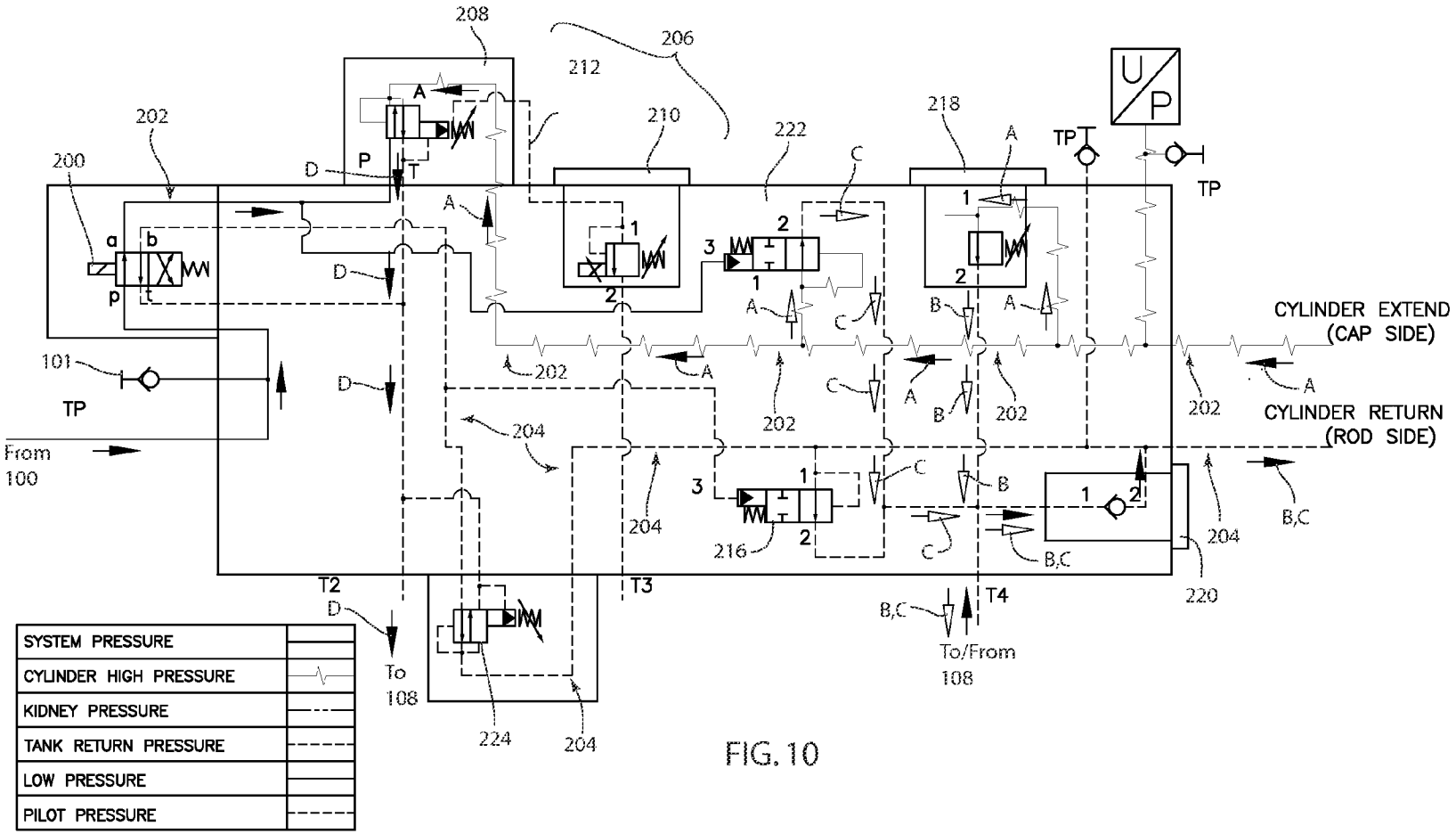
FIG. 10 is a schematic view of the secondary manifold when the retarder is closed and a wheel enters the brake.
Figure 11:
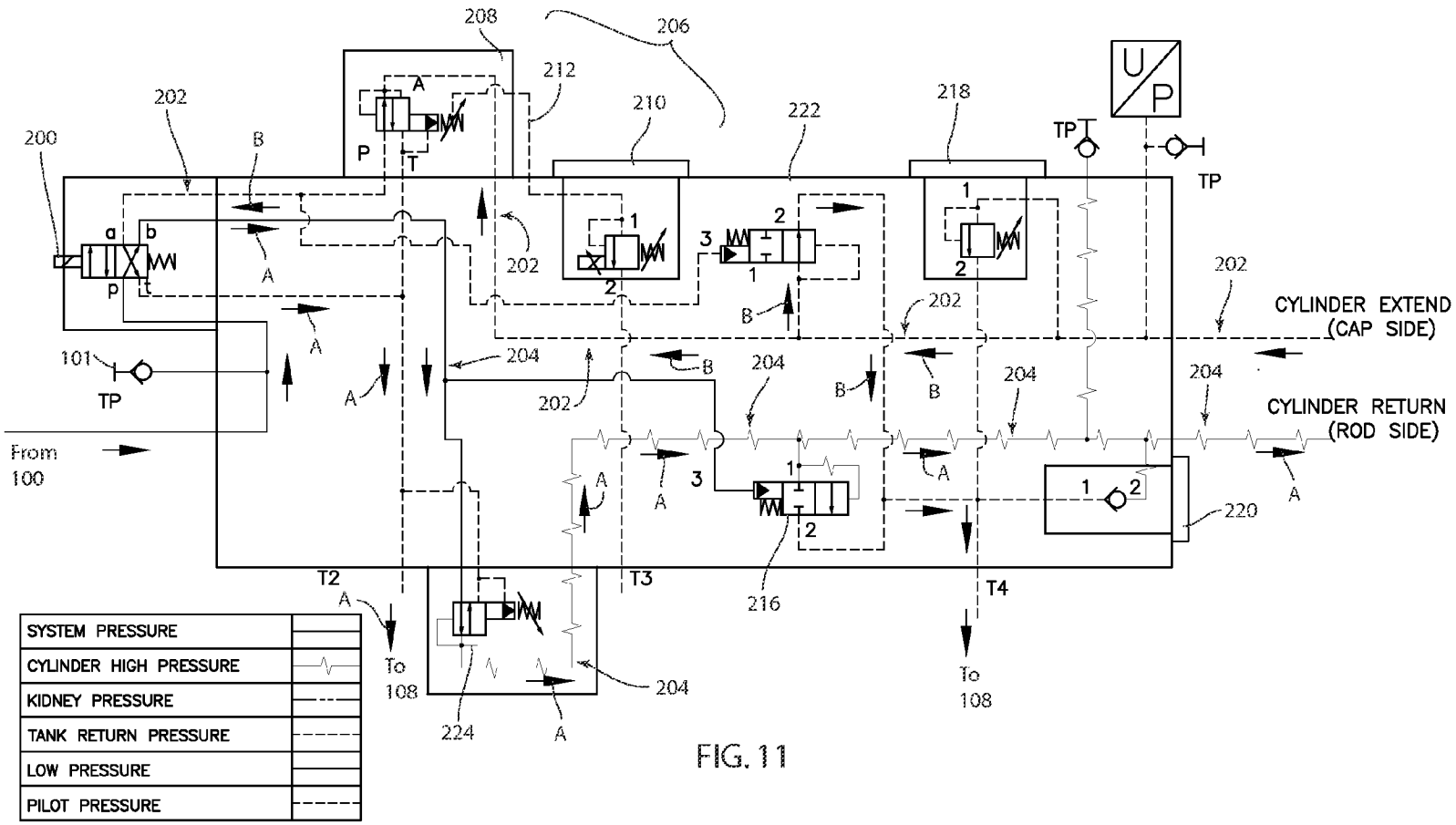
FIG. 11 is a schematic view of the secondary manifold opening the retarder.

Referring to FIGS. 9-11, hydraulic fluid flows from the main manifold 100 to the secondary manifold 102 and initially through a test port 101, which allows an operator to confirm that the pump 110 is supplying the secondary manifold 102 with hydraulic fluid having a correct pressure. The hydraulic fluid is then directed through a directional control valve 200. The directional control valve 200 can include any one of a variety of directional control valves capable of moving between a position wherein flow of hydraulic fluid from the pump 110 to the cap-side chamber 66 of the piston-cylinder 42 is provided, and a position wherein flow of hydraulic fluid from the pump 110 to the rod-side chamber 64 of the piston-cylinder 42 is provided. In both positions, the directional control valve 200 can cause the pressure in the piston-cylinders 42 to remain at a desired level. If more hydraulic pressure is not required at the piston-cylinders 42, the pressure between the pump 110 and the directional control valve 200 will increase as the accumulator 158 stores energy. Once a certain pressure (e.g. 1,500 psi) in the retarder system 20 is obtained, flow from the pump 110 will cease. Other pressure limits can be employed.

Thus, the directional control valve 200 is movable between a position shown in FIG. 9 wherein fluid is pumped into a first manifold 202 to move the brake 30 into its closed position and a position shown in FIG. 11 wherein fluid is pumped into a second manifold 204 to move the brake 30 into its open position. FIGS. 9, 10 and 11 are discussed herein below in turn.

FIG. 9 depicts the structure and function of the secondary manifold 102 during a closing condition of the brake 30. To close the brake 30, the control circuit C controls the directional control valve 200 to direct flow of hydraulic fluid to the first manifold 202, as shown by the arrows A in FIG. 9. Hydraulic fluid initially flows through a logic element 206, which controls pressure of the fluid in the first manifold 202. The logic element 206 includes a pressure control valve 208 and a pilot control valve 210 that control the pressure control valve 208. The control circuit C controls the pilot control valve 210 to thereby control the pressure control valve 208 and thus the pressure of the fluid in the first manifold 202. Specifically, the control circuit C is configured to send a plurality of different electrical signals to the pilot control valve 210, each signal causing the pilot control valve 210 to control the pressure control valve 208 to achieve one of a plurality of different pressures of fluid in the first manifold 202, each corresponding to a different one of the plurality of different braking pressures mentioned above. The plurality of different electrical signals can be proportional to the plurality of different pressures of fluid and the plurality of different braking pressures.

The pilot control valve 210 controls the pressure control valve 208 by controlling the pressure of fluid in a pilot line 212 coupled to the pressure control valve 208. The pressure of fluid in the pilot line 212 is maintained proportional to the plurality of different electrical signals. The pressure of fluid in the first manifold 202, which is controlled by the pressure control valve 208, is maintained proportional to the pressure of fluid in the pilot line 212. The pressure control valve 208 directly throttles the pressure of hydraulic fluid, extending the piston-cylinder 42; however this valve activates based on the pressure supplied by the pilot control valve 210 via the pilot line 212. The pilot control valve 210 in turn is activated based upon the electrical signals from the control circuit C and is designed for fine pressure control (as opposed to the pressure control valve 208 which is capable of handling the relatively larger flow generated by the retarder system 20). This configuration thus provides more efficient quick response to open and close commands from the control circuit C.

Hydraulic fluid at the selected pressure flows from the logic element 206 through the first manifold 202 to the cap-side chamber 66 via the cap-side port 60, as shown by the arrows A in FIG. 9. Introduction of hydraulic fluid into the cap-side chamber 66 forces the piston 62 into the noted extended position, thus forcing the upper and lower levers 38, 40 to pivot about the fulcrum pin 36 and close the brake shoes 50 relative to each other. Thus, the brake 30 is moved into a closed condition at a pressure commensurate with the pressure in the first manifold 202.

During movement of the piston 62 into the extended position described above, hydraulic fluid is forced out of the rod-side chamber 64 into the second manifold 204 of the secondary manifold 102 as shown at arrows B in FIG. 9. Hydraulic fluid flows from the rod-side chamber 64 via the rod side port 58 to a logic element 216 disposed in the second manifold 204 and configured to discharge fluid from the second manifold 204, thus facilitating movement of the brake 30 towards its closed position. The logic element 216 discharges fluid from the second manifold 204, as shown at arrows C, when pressure of the fluid between the logic element 216 and the piston-cylinder 42 exceeds pressure of the fluid opposite the logic element 216 with respect to the piston-cylinder 42 by a certain amount. Simultaneously, the noted passageway 68 in the piston 62 facilitates flow of fluid from the rod side chamber 64 to the cap-side chamber 66, thus further facilitating quicker movement of the brake 30 into the closed position.

FIG. 10 depicts the secondary manifold 102 when the brake 30 is in the closed position and is forced into the open position by a wheel traveling into the brake 30. As the wheel enters the brake 30, the brake shoes 50 are forced apart, thus forcing the upper and lower levers 38, 40 together, thereby compressing the piston-cylinder 42 and forcing the piston 62 into its retracted position. This movement of the piston 62 forces hydraulic fluid from the cap-side chamber 66 back into the first manifold 202, as shown at arrows A in FIG. 10, thus increasing the pressure of the hydraulic fluid in the first manifold 202. A series of mechanisms are provided to maintain the predetermined pressure within the first manifold 202 and avoid overpressure thereof. First, a relief valve 218 is disposed in the first manifold 202 between the logic element 206 and the piston-cylinder 42. The relief valve 218 is configured to direct relatively high pressure hydraulic fluid from the first manifold 202 to the reservoir 108 and also to the rod side chamber 64 via the rod side port 58, as shown by arrows B in FIG. 10. A check valve 220 disposed in the second manifold 204 is movable between a closed position and an open position to facilitate flow of fluid there through to the rod-side chamber 64 such that movement of the brake 30 towards the open position is facilitated. Flow of fluid from the second manifold 204 to the rod side chamber 64 of the piston-cylinder 42 is facilitated when the pressure between the check valve 220 and the piston-cylinder 42 is less than the pressure opposite the check valve 220 with respect to the piston-cylinder 42.

In addition, a logic element 222 is disposed in the first manifold 202 between the logic element 206 and the relief valve 218. When the wheel of the railcar enters the brake 30 and the brake 30 is moved towards its open position, the pressure of fluid between the logic element 222 and the relief valve 218 exceeds a pilot pressure from the pump 110, the logic element 222 discharges fluid from the first manifold 202, as shown at arrows C in FIG. 10. The first pressure amount at which the relief valve 218 discharges fluid from the first manifold 202 can be set greater than the pilot pressure from the pump 110, such that as pressure increases in the first manifold 202, the logic element 222 opens before the check valve 218, thus providing a staged discharging of fluid from the first manifold 202. The logic element 206 can also be configured to discharge fluid from the first manifold 202 such that pressure of fluid between the logic element 206 and the hydraulic piston-cylinder 42 does not exceed the pressure requested by the control circuit C. Discharge from the logic element 206 is illustrated at arrows D in FIG. 10.

FIG. 11 depicts the secondary manifold 102 when the brake 30 is moved into the open position. To open the brake 30, the control circuit C controls the directional control valve 200 to direct flow of hydraulic fluid to the second manifold 204, as shown by the arrows A in FIG. 11. Hydraulic fluid initially flows through a pressure control valve 224 disposed in the second manifold 204 and reducing pressure of hydraulic fluid flowing from the pump 110 to the piston-cylinder 42. Hydraulic fluid at a selected pressure determined by the pressure control valve 224 flows through the second manifold 204 as shown at arrows A to the rod-side chamber 64 of the piston cylinder 42. Introduction of hydraulic fluid into the rod-side chamber 64 forces the piston 62 into the noted retracted position, thus forcing the upper and lower levers 38, 40 to pivot about the fulcrum pin 36 and open the brake shoes 50 relative to each other. Thus, the brake 30 is moved into an open condition at a pressure commensurate with the pressure in the second manifold 204.

During movement of the piston 62 into the retracted position described above, hydraulic fluid is forced out of the cap-side chamber 66 via the cap-side court 60, as shown by arrows B in FIG. 11. Hydraulic fluid flows from the cap-side chamber 66 via the cap-side court 60 to the various means for discharging hydraulic fluid in the secondary manifold 102 disclosed herein above.

It will thus be understood by those having ordinary skill in the art that the present disclosure provides systems for retarding the speed of a railcar that have improved efficiency and effectiveness over the prior art. The examples disclosed herein advantageously allow for efficient and timely movements of the brake between open and closed positions. The parallel connection of the pump and accumulator provide fast acting application at high pressure states. The surge suppression and pressure control provided by the logic elements and relief valve configurations allow for efficient extension and retraction for application of braking forces. The examples disclosed herein are simple to control and provide numerous advantages over the prior art systems, as will be recognized by those having ordinary skill in the art.

What is claimed is:

1. A system for retarding the speed of a railcar, the system comprising:

a brake;

a hydraulic actuator moving the brake between a closed position in which the brake applies braking pressure on a wheel of the railcar and an open position in which the brake does not apply braking pressure on the wheel of the rail car;

a hydraulic circuit comprising a first manifold and a second manifold;

a pump configured to pump hydraulic fluid into at least one of the first manifold and the second manifold; and a first logic element controlling pressure of the fluid in the first manifold such that when the wheel enters the brake and forces the brake towards the open position, the logic element reacts to maintain a selected pressure in the first manifold, thus causing a selected braking pressure to be applied by the brake on the wheel of the railcar;

wherein the actuator comprises a piston disposed in a cylinder, wherein the piston extends from the cylinder into an extended position to move the brake into the closed position and wherein the piston retracts into the cylinder into a retracted position to move the brake into the open position;

wherein the piston defines a passageway there-through, wherein said passageway facilitates flow of fluid between a cap-side of the cylinder and a rod-side of the cylinder when the piston is moved from the extended position to the retracted position, thus facilitating movement of the brake from the closed position to the open position.

2. A system according to claim 1, wherein the passageway facilitates flow of fluid between the cap-side of the cylinder and the rod-side of the cylinder when the piston is moved between the extended position and the retracted position, thus facilitating movement of the brake between the closed position and the open position.

3. A system for retarding the speed of a railcar, the system comprising:

a brake;

a hydraulic actuator moving the brake between a closed position in which the brake applies braking pressure on a wheel of the railcar and an open position in which the brake does not apply braking pressure on the wheel of the rail car;

a hydraulic circuit comprising a first manifold and a second manifold;

a pump configured to pump hydraulic fluid into at least one of the first manifold and the second manifold;

a first logic element controlling pressure of the fluid in the first manifold such that when the wheel enters the brake and forces the brake towards the open position, the logic element reacts to maintain a selected pressure in the first manifold, thus causing a selected braking pressure to be applied by the brake on the wheel of the railcar;

a relief valve between the first logic element and the actuator; wherein when the wheel enters the brake and the brake is moved towards the open position, and the pressure of fluid between the first relief valve and the actuator exceeds a first pressure amount, the relief valve discharges fluid from the first manifold; and a second logic element disposed in the first manifold between the first logic element and the relief valve; wherein when the wheel enters the brake and the brake is moved towards the open position, and the pressure of fluid between the second logic element and the relief valve exceeds a pilot pressure from pump, the second logic element discharges fluid from the first manifold;

wherein the second logic element discharges fluid from the first manifold to the actuator via the second manifold.

4. A system according to claim 3, comprising a check valve disposed in the second manifold, the check valve being movable between a closed position and an open position to facilitate movement of the brake towards the open position, wherein a flow of fluid from the second manifold to the actuator is facilitated when the pressure between the check valve and the actuator is less than the pressure opposite the check valve with respect to the actuator.

5. A system according to claim 4, wherein the check valve receives fluid from the second logic element.

6. A system for retarding the speed of a railcar, the system comprising:

a brake;

a hydraulic actuator moving the brake between a closed position in which the brake applies braking pressure on a wheel of the railcar and an open position in which the brake does not apply braking pressure on the wheel of the rail car;

a hydraulic circuit comprising a first manifold and a second manifold;

a pump configured to pump hydraulic fluid into at least one of the first manifold and the second manifold;

a first logic element controlling pressure of the fluid in the first manifold such that when the wheel enters the brake and forces the brake towards the open position, the logic element reacts to maintain a selected pressure in the first manifold, thus causing a selected braking pressure to be applied by the brake on the wheel of the railcar;

a control circuit selecting the braking pressure from a plurality of different braking pressures and controlling the first logic element to apply the braking pressure on the wheel of the railcar;

wherein the first logic element comprises a pressure control valve and a pilot control valve controlling the pressure control valve; wherein the control circuit controls the pilot control valve to thereby control the pressure control valve and thus the pressure of the fluid in the first manifold;

wherein the control circuit is configured to send a plurality of different signals to the pilot control valve each signal in the plurality causing the pilot control valve to control the pressure control valve to achieve a different one of a plurality of different pressures of fluid in the first manifold, which each correspond to a different one of the plurality of different braking pressures;

wherein the plurality of different signals are proportional to the plurality of different pressures of fluid and the plurality of different braking pressures; and wherein the pilot control valve controls the pressure control valve by controlling pressure of fluid in a pilot line coupled to the pressure control valve, wherein the pressure of the fluid in the pilot line is maintained proportional to the plurality of different signals; and wherein the pressure of fluid in the first manifold, which is controlled by the pressure control valve, is maintained proportional to the pressure of the fluid in the pilot line;

wherein the control circuit controls the flow of fluid into the first manifold and out of the second manifold to move the brake towards the closed position and controlling the flow of fluid into the second manifold and out of the first manifold to move the brake towards the open position; and wherein the system further comprises a directional control valve located in the first manifold, the directional control valve being movable between a first position wherein fluid is pumped into the first manifold to move the brake into the closed position and a second position wherein fluid is pumped into the second manifold to move the brake into the open position, wherein the control circuit controls movement of the directional control valve between the first and second positions.

7. A system according to claim 6, wherein the actuator comprises a piston disposed in a cylinder, wherein the piston extends from the cylinder into an extended position to move the brake into the closed position and wherein the piston retracts into the cylinder into a retracted position to move the brake into the open position.

8. A system according to claim 7, wherein the first and second manifolds are coupled to opposite sides of the actuator, respectively.

9. A system according to claim 6, comprising a relief valve between the first logic element and the actuator; wherein when the wheel enters the brake and the brake is moved towards the open position, and the pressure of fluid between the first relief valve and the actuator exceeds a first pressure amount, the relief valve discharges fluid from the first manifold.

10. A system according to claim 9, comprising a second logic element disposed in the first manifold between the first logic element and the relief valve; wherein when the wheel enters the brake and the brake is moved towards the open position, and the pressure of fluid between the second logic element and the relief valve exceeds a pilot pressure from pump, the second logic element discharges fluid from the first manifold.

11. A system according to claim 10, wherein the first pressure amount is greater than the pilot pressure from the pump.

12. A system according to claim 6, comprising a second logic element disposed in the second manifold and configured to discharge fluid from the second manifold, thus facilitating movement of the brake towards the closed position, when pressure of fluid between the second logic element and the actuator exceeds pressure of fluid opposite the second logic element with respect to the actuator by a certain amount.

13. A system according to claim 6, comprising a pressure control valve disposed in the second manifold and reducing pressure of fluid flowing from the pump to the actuator via the second manifold.

14. A system according to claim 6, wherein the first logic element discharges fluid from the first manifold such that pressure of fluid between the first logic element and the actuator does not exceed the pressure of fluid in the pilot line.

15. A system according to claim 6, comprising a pressure transducer disposed in the first manifold and configured to indicate pressure of the fluid in the first manifold.

16. A system according to claim 6, wherein the pump is a variable displacement pump.

17. A system according to claim 16, comprising a motor driving the pump.

18. A system according to claim 17, comprising a check valve disposed in the hydraulic circuit downstream of the pump, the check valve preventing the pump from back-spinning when the motor is turned off.

19. A system according to claim 18, comprising a pressure relief valve disposed downstream of the check valve, the pressure relief valve preventing the hydraulic circuit from over-pressure.

20. A system according to claim 6, comprising a filter disposed in the hydraulic circuit, the filter filtering fluid flowing through the circuit.

21. A system according to claim 6, wherein the hydraulic circuit comprises a kidney loop configured to control a temperature characteristic of the fluid in the circuit, wherein the pump pumps fluid from a reservoir through the kidney loop and back to the reservoir.

22. A system according to claim 21, comprising a check valve preventing backflow of fluid to the pump.

23. A system according to claim 21, comprising a pressure relief valve restricting flow of fluid through the kidney loop to heat the fluid.

24. A system according to claim 23, comprising a heat exchanger cooling fluid in the kidney loop.

25. A system for retarding the speed of a railcar, the system comprising:

a brake;

a hydraulic actuator moving the brake between a closed position in which the brake applies braking pressure on a wheel of the railcar and an open position in which the brake does not apply braking pressure on the wheel of the rail car;

a hydraulic circuit comprising a first manifold and a second manifold;

a pump configured to pump hydraulic fluid into at least one of the first manifold and the second manifold;

a first logic element controlling pressure of the fluid in the first manifold such that when the wheel enters the brake and forces the brake towards the open position, the logic element reacts to maintain a selected pressure in the first manifold, thus causing a selected braking pressure to be applied by the brake on the wheel of the railcar;

a control circuit controlling the flow of fluid into the first manifold and out of the second manifold to move the brake towards the closed position and controlling the flow of fluid into the second manifold and out of the first manifold to move the brake towards the open position;

a directional control valve located in the first manifold, the directional control valve being movable between a first position wherein fluid is pumped into the first manifold to move the brake into the closed position and a second position wherein fluid is pumped into the second manifold to move the brake into the open position, wherein the control circuit controls movement of the directional control valve between the first and second positions; and a hydraulic accumulator disposed in the hydraulic circuit between the pump and the directional control valve, the accumulator receiving and providing fluid to the circuit.

26. A system according to claim 25, wherein the accumulator and pump supply fluid to the actuator in parallel.

27. A system according to claim 26, wherein fluid flows from the pump to one of the accumulator and to a portion of the hydraulic circuit downstream of the accumulator, whichever has the lower pressure.

28. A system for retarding the speed of a railcar, the system comprising:

a brake;

a hydraulic actuator moving the brake between a closed position in which the brake applies braking pressure on a wheel of the railcar and an open position in which the brake does not apply braking pressure on the wheel of the rail car;

a hydraulic circuit comprising a first manifold and a second manifold;

a pump configured to pump hydraulic fluid into at least one of the first manifold and the second manifold;

a first logic element controlling pressure of the fluid in the first manifold such that when the wheel enters the brake and forces the brake towards the open position, the logic element reacts to maintain a selected pressure in the first manifold, thus causing a selected braking pressure to be applied by the brake on the wheel of the railcar;

wherein the hydraulic circuit comprises a kidney loop configured to control a temperature characteristic of the fluid in the circuit, wherein the pump pumps fluid from a reservoir through the kidney loop and back to the reservoir;

a pressure relief valve restricting flow of fluid through the kidney loop to heat the fluid;

a heat exchanger cooling fluid in the kidney loop; and a directional control valve movable between a first position wherein fluid is pumped to the pressure relief valve and a second position wherein fluid is pumped to the heat exchanger.

29. A system according to claim 28, wherein the control circuit controls the directional control valve, the pressure relief valve and the heat exchanger to maintain the fluid in a temperature range.

30. A system according to claim 29, comprising a filter filtering fluid in the kidney loop.

* * * * *